United States Patent [19]

Wiggins

[11] 4,020,866

[45] May 3, 1977

[54] PRESSURE VESSEL FOR VOLTAGE BLOCK MATERIAL SUPPLY SYSTEM

[75] Inventor: Richard F. Wiggins, Fairfield, Conn.

[73] Assignee: The Gyromat Corporation, Stratford, Conn.

[22] Filed: June 13, 1975

[21] Appl. No.: 586,557

Related U.S. Application Data

[62] Division of Ser. No. 421,504, Dec. 3, 1973, Pat. No. 3,933,285.

[52] U.S. Cl. ..... 137/592; 222/56; 222/190; 239/3; 361/228

[51] Int. Cl.[2] ..... B67D 5/08

[58] Field of Search ..... 137/592, 375; 222/56, 222/190, 399, 564; 259/4; 141/392, 286; 239/3; 317/3; 215/311, 312, 313, 314, 315

[56] References Cited

UNITED STATES PATENTS

| | | | |
|---|---|---|---|
| 2,693,805 | 11/1954 | Taplin et al. | 128/266 |
| 3,122,320 | 2/1964 | Beck et al. | 239/3 |
| 3,135,411 | 6/1964 | Osborne | 215/314 X |
| 3,212,671 | 10/1965 | Rock | 222/56 X |
| 3,234,854 | 2/1966 | Aber | 137/592 X |
| 3,474,820 | 10/1969 | O'Neill, Jr. | 137/375 |
| 3,499,577 | 3/1970 | Nilsson | 222/56 X |
| 3,534,788 | 10/1970 | Vergobbi | 141/392 |
| 3,588,054 | 6/1971 | Ljungberg | 259/4 R |
| 3,814,147 | 6/1974 | Lindberg | 141/94 |
| 3,864,603 | 2/1975 | Kozinski | 317/3 X |

*Primary Examiner*—William R. Cline
*Attorney, Agent, or Firm*—Mandeville and Schweitzer

[57] ABSTRACT

The disclosure relates to an improved electrostatic paint spray system adapted for the application of conductive materials while at the same time providing for isolation of the electrically charged spray heads from the source of coating material. Heretofore, electrostatic paint spray procedures have been limited to a large extent to the use of non-conductive coating materials. Where it is appropriate or desirable to utilize conductive coating materials, it has been necessary to provide for the electrical isolation of the entire paint supply system, a circumstance which imposes severe practical limitations. The present invention enables an isolating stage to be provided within the coating material supply system, near the area of discharge, so that the "upstream" portions of the supply system are free of the high voltage electrical charge impressed at the spray guns, notwithstanding the use of electrically conductive coating materials.

6 Claims, 7 Drawing Figures

PRESSURE VESSEL FOR VOLTAGE BLOCK MATERIAL SUPPLY SYSTEM

This is a division of application Ser. No. 421,504, filed Dec. 3, 1973, now U.S. Pat. No. 3,933,285.

BACKGROUND AND SUMMARY OF THE INVENTION

In industrial finishing processes, electrostatic spray coating is widely used because of its high deposition efficiencies and because of the ability of the process to apply coating material to surfaces not directly "seen" by the spray head. This is achieved by reason of electrostatic attraction of charged particles of coating material, a phenomenon generally referred to as "wrap-around". In a typical industrial process, utilizing spray heads mounted on an automatic reciprocator apparatus, for example, the spray device may be charged to levels of around 125,000 volts. The incoming coating material is finely atomized in the presence of these high electrical voltages, with the result that the individual, atomized particles of coating material become electrically charged. They are then attracted with high efficiency to a nearby workpiece, which is also electrically charged, but with the opposite polarity.

Because of the extremely high voltage utilized in electrostatic spray coating processes, and the inherently hazardous conditions created by the presence of such voltages, it has been conventional practice, wherever feasible, to utilize coating materials of an essentially non-conductive character. In general, this has required the use of non-conductive pigments suspended in non-conductive solvent vehicles. In special cases, as in the application of paints with metallic pigment components, for example, or where the situation for some reason requires a conductive vehicle, it has been necessary to electrically isolate the entire paint supply system. Typically, this has involved use of closed, pressurized containers of the coating material, placed nearby the spray outlets and mounted in an insulated manner. This conventional arrangement has serious drawbacks for many industrial processes, because of the inherently low volume of material that can be held in a charged container of practical size, the need in many cases to shut down an entire production line from time to time for refilling of the containers and the additional hazard involved in the presence of a large body charged to extremely high voltages. These practical disadvantages have seriously limited the use of conductive coating materials in large scale industrial processes.

In accordance with present invention, it is made possible to utilize highly conductive coating materials in industrial coating lines in a wholly practical way, by introducing in the paint supply system a unique arrangement for blocking or isolating the feedback of high voltage to "upstream" portions of the paint supply. The voltage isolating arrangement is incorporated in the material supply system in the vicinity of the spray discharge means, so that the entire paint supply system upstream thereof is kept free of a voltage charge.

In its broadest concepts, the present invention provides for a paint supply system, including a non-electrically charged supply stage and an electrically charged discharge stage, with a transition stage being provided therebetween for the continuous interruption of the liquid path while at the same time providing for the continuous supply of coating materials to the highly charged spray discharge means. In a more specific sense, one of the advantageous forms of the invention provides a voltage isolating stage in a paint supply system in which coating material, may be continuously discharged from the spray head and may be continuously supplied from the source, is transferred from the supply stage to the discharge stage in an incremental or step-wise fashion, so that the supply stage at all times remains electrically isolated from the high voltage impressed upon the discharge stage.

The new system of the invention enables unique advantages to be realized, in that it enables the unrestricted use of water-based coating materials. Heretofore, it has been necessary to a great extent to utilize non-conductive solvent vehicles. In terms of atmospheric pollution, the use of such solvents presents a serious problem to the industrial finisher. In many cases, regulations require that virtually all of the volatilized solvents be recaptured and prevented from entering the atmosphere. The use of water-based vehicles, of course, completely avoids this serious problem and the significant cost and other factors involved in dealing with it.

For a better understanding of the invention, reference should be made to the following detailed description and to the accompanying drawings.

DESCRIPTION OF PREFERRED EMBODIMENTS

Figure 1:
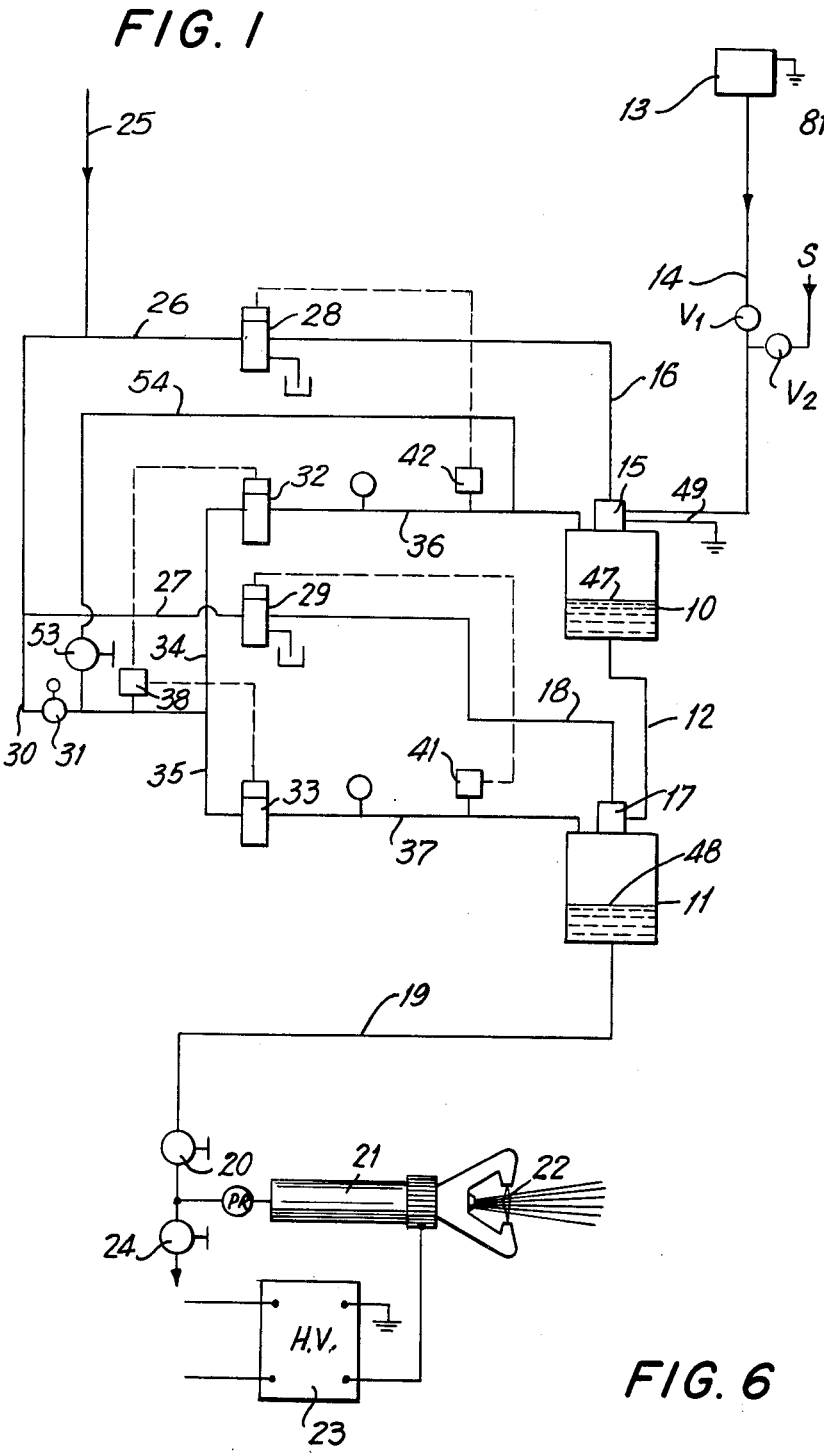
FIG. 1 is a highly simplified, schematic representation of an individual type electrostatic spray coating system utilizing the voltage blocking or isolating stage of the invention.

Referring now to the drawing, and initially to FIGS. 1–5 thereof, the reference numerals 10, 11, represent pressure vessels for the transient storage of coating material. For purposes of the description, the upper vessel 10 may be referred to as the lock tank or lock vessel, and the lower vessel 11 may be referred to as the voltage block tank or vessel. To greatest advantage, the lock tank is located physically above the voltage block tank 11, providing for communication by gravity from the lock tank to the voltage block tank, through a conduit 12.

In the system illustrated in FIG. 1, coating material, which may be a water-based or other conductive material, is derived from a source 13, which is maintained under pressure or arranged to be pressurized at desired times and is maintained at ground potential. The coating material source 13 communicates through a supply conduit 14 and lock valve 15 with the upper end of the lock tank 10. When the valve 15 is open, it permits the flow of coating material through the supply conduit 14 and into the lock tank 10. The valve 15 may be of the general type described in my earlier U.S. Pat. No. 3,648,717, granted Mar. 14, 1972, which is actuated to open or closed positions by a control air line 16, to be further described.

Communication between the lock tank 10 and voltage block tank 11 is controlled by a transfer valve 17, which may be of similar construction to the lock valve 15 and is controlled between open and closed positions through a control air line 18. The voltage block tank 11 has an outlet at its lower end, communicating through a discharge conduit 19 and manually controlled shut-off valve 20 with a spray discharge device 21. The form of the spray discharge device 21 is not significant to the invention. However, it is contemplated that the discharge device will be charged to high voltage relative to ground, to enable an electrical charge to be imparted to atomized spray material being discharged from the spray device at 22. Schematically, a high voltage power source is indicated at 23. In a typical so-called automatic spray line, the high voltage supply 23 may have an output voltage of 125 KV.

An additional normally closed manual control valve 24 is provided on the downstream side of the spray device 21, enabling the spray device to be by-passed, when desired, for clean out operations, etc.

In the operation of a high voltage electrostatic spray coating system, for the application of conductive coating materials, the use throughout the system of insulating materials for the supply conduits and the like is not effective to isolate the coating material source 13 from the high voltage supply 23, because of the conductivity of the coating material itself. Typical such coating materials are water-based materials and/or materials having substantial metallic content, for example. Thus, in the past, in order to use such material in a high voltage operation, it has been necessary to provide for the complete electrical isolation of the supply source 13 itself. Typically, this has involved utilizing a closed, pressurized container supported in insulated fashion adjacent to the spray device 21. Desirably, such isolated containers are rather small in size, to avoid presenting an unduly large body at high voltage in the working area. Thus, there is a need to refill the closed vessel relatively frequently and, with conventional equipment, this necessitates completely shutting down spray coating equipment, and possibly an entire conveyor line.

In accordance with the broadest principle of the invention, complete isolation of the material supply source 13 from the high voltage discharge device 21 is effected by providing at all times for a controlled interruption of the continuity of the coating material between the spray device and the supply source. Importantly, however, the discontinuity of the coating material must be such as to enable an uninterrupted supply of coating material to be delivered to the spray device 21 under highly uniform pressure conditions. To this end, the lock tank and voltage block tank 10, 11, are arranged to serve as reservoirs for a reasonable volume of coating material, and the valves 15, 17 are arranged for inter-related actuation and de-actuation, such that there can never be a continuity of coating material from the discharge end of the voltage block tank 11 to the supply valve 15 for the lock tank. The arrangement, as will more fully appear, permits the coating material to be replenished at will and in complete safety at the supply source 13, in accordance with consumption requirements. A system of the invention additionally provides for the automatic and properly sequenced replenishing of the conductive coating material to maintain a constant supply of such material, under uniform pressure conditions, to the spray device 21.

Figure 5:
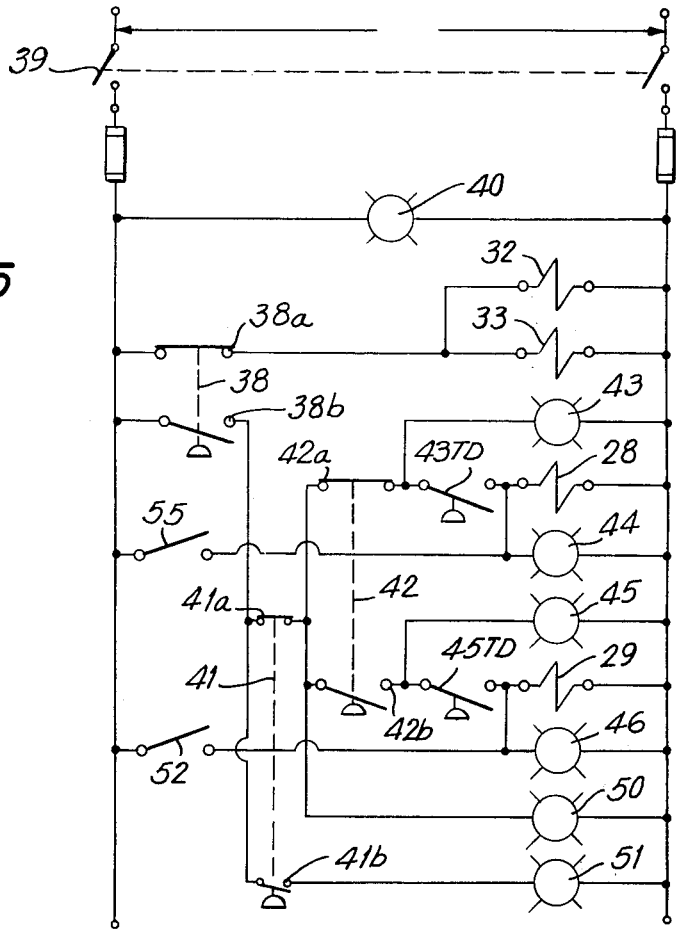
FIG. 5 is a simplified schematic representation of an electrical control system utilized to advantage in the operation of the system in FIG. 1.

Referring now to FIGS. 1 and 5 in particular, the system of the invention, in one of its most basic forms includes a source of air under pressure, designated by the reference numeral 25. Typically, this may be the conventional plant air system at a pressure, for example, 60–80 psi (which is not critical to the invention). The supply line 25 is connected through conduits 26, 27 and solenoid actuated, 3-way control valves 28, 29 respectively to the control air lines 16, 18. When the valves 28, 29 are actuated to open positions, control air is supplied through conduits 16 or 18 to the lock valve 15 or transfer valve 17, as the case may be, to open these valves and permit flow of coating material into one or the other of tanks 10, 11. When the valves 28 or 29 are de-actuated, control air is exhausted, effecting closure of the valves 15, 17.

The plant air supply is also connected through a conduit 30 and manually controllable pressure regulating valve 31 to a pair of 2-way solenoid valves 32, 33, through conduits 34, 35. The downstream sides of the respective valves 32, 33 are connected through conduits 36, 37 to the upper ends of the tanks 10, 11 respectively.

To prepare the system for operation, the valves 32, 33 are caused to be in an open condition, and the system operator commences to charge the respective lock tank 10 and voltage block 11 with air under pressure by manually opening the pressure regulator 31 to an increased pressure setting. When the pressure within the tanks 10, 11 reaches a desired level (typically around 12 psi but any suitable pressure may be utilized within the teachings of the invention) a pressure switch 38 is actuated, de-energizing the solenoid valves 32, 33 and sealing off the tanks 10 and 11 with the desired air precharge.

With reference to the schematic control circuit of FIG. 5, the initial precharge of the system is effected by closing the main power switch 39, energizing a "system on" indicator light 40 and energizing the two solenoid valves 32, 33 through normally closed contacts **38*a* of the pressure switch 38. As the precharged pressure comes up to the preset limit, the pressure switch 38 actuates, opening its contacts 38*a* and closing its contacts 38*b*. The solenoid valves 32, 33** are thereupon de-energized, and the second control stage is commenced.

Through the now-closed contacts **38*b*, normally closed contacts 41*a* of a second pressure switch 41, and through normally closed contacts 42*a* of a third pressure switch 42, a control relay 43 is energized. The relay 43, in accordance with one aspect of the invention, has a set of time-delay-on contacts 43TD, which close a preset time interval after energizing of the relay 43. When thus closed, the contacts 43TD cause energization of the solenoid valve 28 along with an indicator light 44** that signifies the lock tank is filling.

When the solenoid valve 28 is energized, the lock valve 15 is actuated to an open condition, and coating material is admitted to the upper end of the lock tank 10, it being understood that the supply source 13 is maintained at a pressure in excess of the pressure within the lock tank to provide for the desired flow. As the coating material enters the lock tank, and the level of the material rises within the tank, the body of pre-charged air trapped within the lock tank is compressed in the top of the tank. When this pressure reaches a desired, predetermined level, typically around 25 psi, the pressure switch 42, communicating with the lock tank through the air line 36, is actuated to open its contacts 42*a* and close a second set of contacts 42*b*. The control relay 43 and its associated solenoid valve 28 are immediately de-energized, and air is thereby released from the lock valve 15 causing it to return to its closed position and stopping the flow of coating material from the source 13.

Through the now-closed contacts 42*b* of the pressure switch 42, a control relay 45 is energized and, a predetermined time delay period later, a set of time-delay-on contacts 45TD are closed, to energize the solenoid valve 29 and an associated indicator light 46 reflecting transfer flow of the coating material. When the solenoid valve 29 is energized, air is permitted to the transfer valve 17, opening the valve and permitting a flow of coating material through the transfer conduit 12 and into the voltage block tank 11.

As will be understood, coating material contained within the voltage block tank 11 may be charged to the high voltage of the discharge device 21, through the conductive path provided by the coating material itself. Accordingly, to avoid imparting a charge to the lock valve 15, and thereby providing a charge path to the paint supply 13, the system of the invention provides for an adequate delay, between the closing of the lock valve 15 and the opening of the transfer valve 17, to permit the inflow of coating material from the closed valve 15 to be effectively completed, at least to the extent that there can be no solid or substantially solid stream of material extending from the coating material 47 up to the lock valve 15. This is significant because, when the transfer valve 17 is opened, permitting the stream of coating material to flow into the voltage block tank 11, a continuous conductive path will be provided from the charged material 48 in the voltage block tank 11 through the transfer valve 17 and transfer conduit 12 up into the body of coating material 47 in the lock tank 10. The material in the upper tank thus becomes highly charged during material transfer. However, by assuring an adequate discontinuity between the material 47 and the valve 15, the discharge is prevented from reaching the material supply 13.

In addition, although the lock tank 10 is desirably constructed to insulating material, it still may become somewhat charged, because of the unpredictable effects of extremely high voltages to which the system is exposed. Accordingly, it is desirable to provide for an electrical connection of the valve 15 to ground, as at 49, to immediately dissipate any accumulated electrical charge.

As coating material is caused to transfer from the lock tak 10 to the voltage block tank 11, there is an increase in the pressure in the tank 11 and a decrease in pressure in tank 10. Practical experience indicates that, when the pressure in the voltage block approaches that in the lock tank 10, there is a tendency for some of the coating material in the voltage block tank to be electrostatically atomized. To minimize such action, the control system of the invention is arranged to maintain a pressure differential of around 4 to 5 lbs., minimum, between the two tanks. To this end, a pressure drop in the lock tank 10 of, for example, 3 psi (e.g., from 25 psi to 22 psi) during the transfer stage will cause the pressure switch 42 to become deactuated, opening its contacts 42*b* and closing its contacts 42*a*. Control relay 45 and solenoid valve 29 are immediately de-energized, and the transfer valve 17 is closed. Control relay 43 is immediately energized. However, its contacts 43TD close only after a predetermined delay, to provide for complete termination of the solid flow into the lower tank 11. When the contacts 43TD finally close, coating material is re-admitted into the lock tank 10 to bring the pressure therein back up to the desired level of 25 psi. The tank 10, at the start of refilling, has an isolated high voltage charge, but this is immediately discharged to ground at 49 as refilling is commenced. The cycle of filling the lock tank 10 and subsequently transferring a portion of the coating material into the voltage block tank 11 is repeated as many times as necessary, during the initial charging phase, until the pressure in the voltage block tank 11 reaches a predetermined maximum level. Typically, this may be around 20 psi (where the pressure in the upper or lock tank is maintained at a maximum of about 25 psi). It will be understood, of course, that the indicated pressure levels are not in any sense limiting, but merely illustrate the applicable principles.

When the pressure in the voltage block tank 11 reaches the desired maximum, the pressure switch 41 is actuated, opening contacts 41*a* and closing contacts 41*b*. Power to the control relays 43, 45 and their associated solenoid valves 28, 29 is cut off by the contacts 41*a*, so that both of the fluid flow control valves 15, 17 are closed. Likewise, an indicator light 50, reflecting a low level in the voltage block tank, is extinguished, while a similar indicating light 51, reflecting a full condition of the voltage block tank 11, is energized through the contacts 41*b*.

The system will remain in the condition described in the preceding paragraph until an appropriate amount of material is consumed from the system by discharge from the spray device 21. As material comsumption reduces pressure within the voltage block tank 11 to a predetermined level (e.g., 17 psi) the pressure switch 41 is de-actuated, closing the contacts 41*a*. At this stage of operation, the pressure switch 42 has been actuated previously by a desired maximum pressure condition in lock tank 10, such that the control relay 45 is immediately energized, followed after a delay by closure of the contacts 45TD and energization of the solenoid valve 29 to open the transfer valve 17. Incremental replenishment of the respective tanks 10 and 11 then proceeds in a manner described above, automatically, on a demand basis. As will be appreciated, additional coating material may be introduced at the supply source 13 as needed, to keep up with the rate of consumption at the spray device 21.

To empty the system, for cleanout, color change or other reason, the high voltage source 23 is de-energized, and the valve 24, downstream on the spray device, is opened. A manually operated switch 52 may be closed to energize the solenoid valve 29 and open the transfer valve 17, permitting a free flow of material from the lock tank 10, through the voltage block tank 11, to be discharged to the valve 24. In addition, air under pressure can be introduced into the upper tank 10, by means of a manually operated valve 53 and supply conduit 54, communicating with the upper end of the tank 10. For cleanout, the supply line 14 may be disconnected from the lock valve 15, as by a valve $V_1$, permitting cleaning fluid or solvent to be introduced into the system through a valve $V_2$ and supply line S. In this respect, the lock valve 15 may be opened for cleaning by closing of a manual switch 55, to energize the solenoid valve 28.

Figure 2:
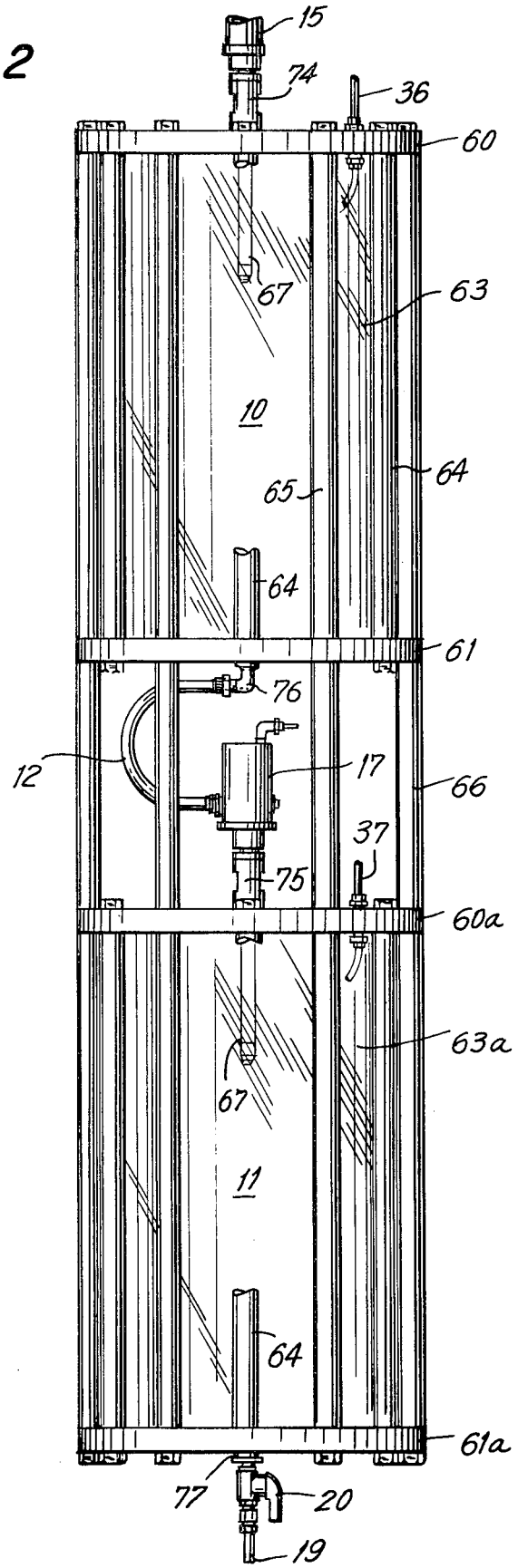
FIG. 2 is an enlarged, cross-sectional view illustrating a preferred form of isolating transfer vessel assembly utilized in the system of the invention.
Figure 4:
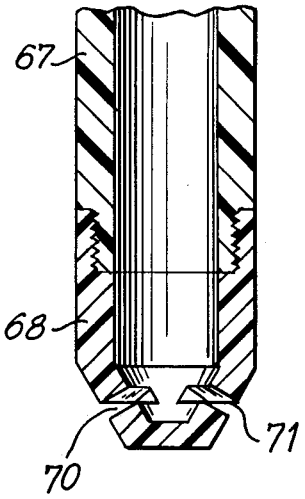
FIG. 4 is an enlarged fragmentary, longitudinal cross-sectional view taken generally on line 4—4 of FIG. 3.
Figure 3:
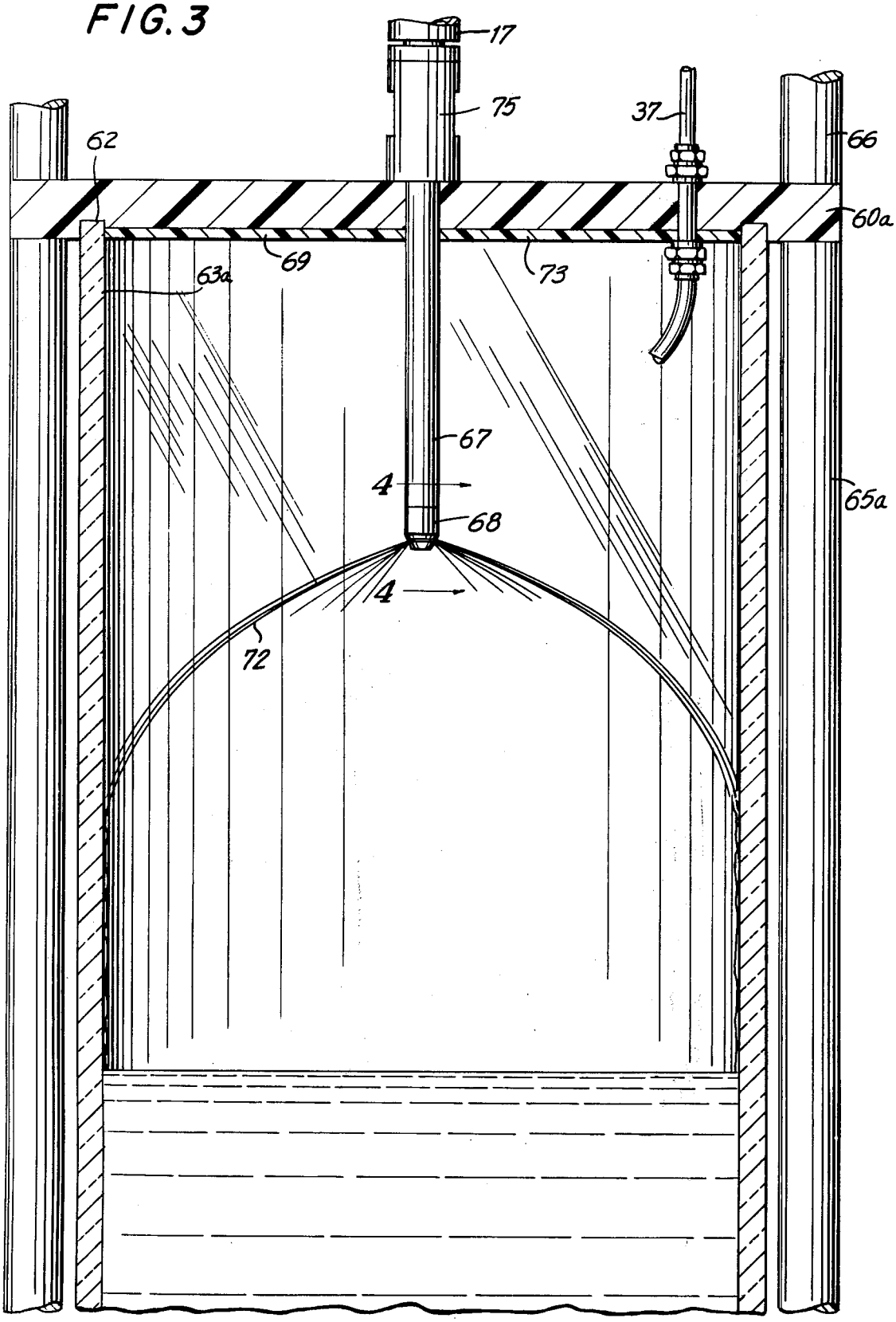
FIG. 3 is an enlarged fragmentary, longitudinal cross-sectional view of the transfer vessel assembly of FIG. 2.

A most advantageous structure, providing a combination lock tank and voltage tank in accordance with the principles of the invention, is reflected in FIGS. 2–4. In the illustrated arrangement, the tanks 10, 11 constitute a unitary rigid structure comprising both transfer tanks and structural means to maintain the same in spaced relation. Each tank is comprised of a pair of end plates 60, 61, (or 60*a*, 61*a*) the opposed faces of which are circularly recessed as at 62 (FIG. 3) to receive in sealing relation the ends of a cylindrical glass tube 63 (or 63*a*). The end plates 60, 61 advantageously are constructed of a plastic, insulating material, such as cast vinyl, and their end plates are drawn tightly into sealing relation with the ends of the glass tubes 63 by means of a plurality of circumferentially spaced tension rods 64, 65. Each of the tanks 10, 11 is of air-tight construction and adapted to maintain without significant leakage an air pressure of at lest around 25 psi.

Alternate ones 65 of the tie rods are associated with spacer rods 66, which extend between the upper and lower tanks, securing them together in a rigid, spaced relationship.

To advantage, the coating material inlet means for each of the tanks 10, 11 is an elongated, vertically disposed tube 67 of plastic insulating material, which projects through the wall 60, 60*a*, along the axis of the cylindrical tank, and projects into the tank, having a discharge nozzle 68 located a substantial distance below the upper wall surface 69. To greatest advantage, the discharge nozzle 68, shown in detail in FIG. 4, is provided with a pair of opposed, circumferentially elongated discharge slots 70, 71. The form of these slots is such that the coating material is discharged therefrom in a substantially solid flat stream 72 (FIG. 3) which is projected to the side walls of the cylindrical glass tube 63 at a point above the maximum liquid level within the tank, such that the incoming coating material joins the liquid body in the tank by flowing downward along the side walls of the glass cylinder. This technique of introducing the coating material into the tanks substantially minimizes frothing and foaming of the coating material, which can be a significant problem particularly in the handling of water-based coating materials.

In a system designed for operation with a high voltage power supply of about 125 KV, the internal diameter of the glass tube 63, forming the side wall of the container 10 or 11, should be approximately 12 inches or greater, providing a free distance of more than 5 inches between the nozzle 68 of the discharge tube and the side walls of the container and thus minimizing any tendency for arcing across this space. Likewise, the discharge tube 67 should terminate a similar distance below the upper wall of the container and above the maximum level of the liquid in the container, so that all of the surfaces facing the end of the discharge tube are substantially beyond arcing distance for the voltage utilized. In this respect, it should be understood that the interior of the tanks 10, 11 is at all times substantially at 100% humidity, so that the ambient within the tanks is relatively conductive.

Desirably, the lower surface of the plastic plates 60, 60*a*, forming an upper wall of a tank is lined along its lower or interior surface with a layer 73 of material, such as Teflon (polytetrafluoroethylene), which is relatively non-wettable by water. In this respect, over a period of normal operation, condensation of water may form on the upper wall of the tank interior. By providing a relatively non-wettable surface 73, the condensed water is caused to form into discrete droplets, and eventually fall into the liquid body below, rather than to spread out and form a continuous conductive path across the upper wall. This minimizes any tendency otherwise present for creating an electrical charge on the fluid control valve mounted on the exterior of the upper wall of the tank.

Communicating with the discharge tube 67 in each of the tanks 10, 11 is a fluid control valve 15 or 17. The fluid control valves typically are constructed largely of metal, and therefore dseirably are spaced above the end plates 60, 60*a* by spacers 74, 75 formed of an insulating material.

Each of the tanks 10, 11 has an outlet fitting 76, 77, the upper fitting 76 leading through a conduit 12 to the transfer valve 17, and the lower fitting 77 being connected to discharge line 19 through stop cock 20. Pressurizing air is introduced into the respective tanks 10, 11 through lines 36, 37.

For some installations, it may be feasible to construct the tank bodies out of metal, provided the inlet values are adequately insulated therefrom. The use of upper end caps of insulating material is suitable in such cases.

Figure 6:
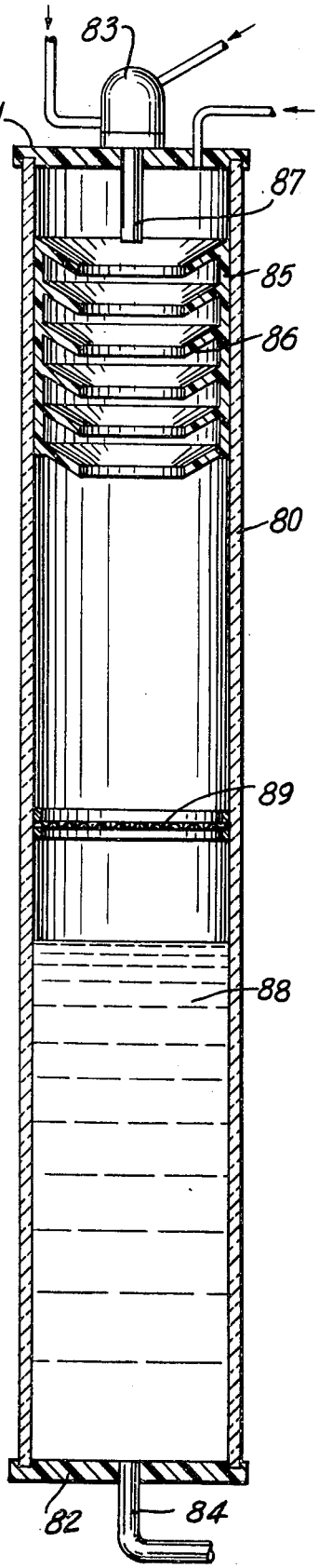
FIG. 6 is an enlarged fragmentary, longitudinal cross-sectional view illustrating the construction of a modified form of transfer vessel which can be utilized in the system of FIG. 1.

A modified form of isolating tank is shown in FIG. 6, enabling voltage block to be achieved with a single vessel. There, an enlongated glass tube 80 is provided with end caps 81, 82 of insulating material, communicating at the top with a coating material valve 83 and at the bottom with a discharge conduit 84. The upper portion of the tank is provided with an annular insulating member 85, formed of Teflon or similar relatively non-wettable material formed with a substantial plurality of inverted frusto-conical rings 86.

With the tank of FIG. 6, electrical discontinuity may be provided by pulsing the inlet valve 83 to inject material in discrete spurts too short to form a continuous between a discharge tube 87 and a liquid body 88.

Coating material which is thus injected into the interior of the tank through the discharge tube 87, passes through a screen member 89 disposed transversely across the body of the tank, and is collected in the liquid body 88 in the lower portion of the tank. The screen 89 functions to prevent splashing and to minimize foaming. Alternatively, coating material may be flowed onto the side walls of the vessel of FIG. 6, above the insulating member 85. The relatively non-wettable insulating member 85 functions to cause water and/or coating material to tend to form into droplets and flow by gravity down to the inner edge of the frusto-conical rings and eventually down into the body 88. This avoids a circuit continuity, which could otherwise result from a liquid film wetting out the inner surface of the tank wall.

In typical operation, the FIG. 6 vessel would be maintained under air pressure, to provide the desired operating pressure at the outlet conduit 84.

Figure 7:
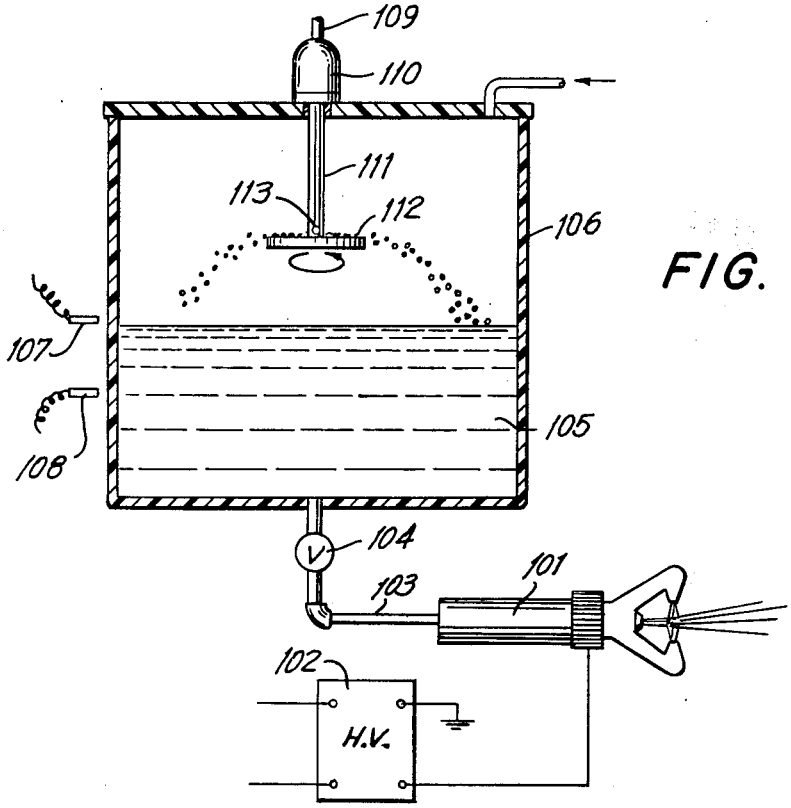
FIG. 7 is a simplified representation of a modified form of voltage isolating system incorporating certain of the teachings of the invention.

FIG. 7 of the drawings illustrates still another form of the invention, in which an effective circuit discontinuity between coating material source and discharge is provided with a single tank arrangement. In the illustration, a spray device 101, charged by high voltage source 102, is connected through a discharge conduit 103 and valve 104 with a confined liquid body 105 maintained under pressure within an insulated tank or vessel 106. A pair of high and low sensor elements 107, 108 (e.g. acoustic or magnetic) may be provided adjacent to tank 106 to detect maximum and minimum desired liquid levels, causing the introduction of additional coating material when the liquid falls to the level of the sensor 108, and discontinuing the input of replacement coating material when the liquid rises to the level of the upper sensor 107. Desirably, the tank 106 is pressurized and, as in the case of the tanks of FIG. 6 or FIG. 2, liquid level may also be controlled by means of pressure sensing switches.

In the arrangement of FIG. 7, coating material under pressure is introduced through a supply conduit 109, connected to a suitable fluid flow control valve (not specifically shown). The fluid enters and flows downwardly through a discharge tube 111. The rotary discharge tube 111 has a horizontal circular plate 112 at its lower end, which is driven to rotate by an air motor 110. The rotary plate 112 is positioned at a level well above that of the contained liquid body 105, so as to avoid arcing between the liquid body and the plate.

In the system of FIG. 7, liquid coating material flows at a controlled rate downwardly through the interior of discharge tube 111 and through apertures 113 near the lower end thereof onto the flat upper surface of the circular plate 112. The rate of rotation of the plate 112 is so coordinated with the rate of inflow of the material through the discharge tube 111 that the incoming coating material is flung off of the plate by centrifugal force, being substantially comminuted to the form of small droplets as it is mechanically cast out from the plate. The individual droplets of coating material move radially outward while falling by gravity and eventually reach the surface of the contained liquid body. As will be appreciated, by appropriate control of flow rate and rotational speed, the liquid coating material may be transferred from the supply line 109 to the contained liquid body 105 without at any time providing a continuity of conductive material. Thus, the contained liquid body 105, which is necessarily charged to high voltage by the supply 102, does not transfer that charge back into the material in the supply of incoming material in the supply line 109.

The system of the invention for the first time enables water-based or other conductive coating materials to be utilized in an otherwise conventional, automated electrostatic spray system, in which a continuous supply of coating material is required to be supplied over a substantial period of time witout process interruption. The system of the invention may conveniently be utilized with conventional recirculating paint supply systems, retaining only a relative minimum quantity of coating materials in the transfer vessels themselves, while permitting the remainder to be recirculated through the conventional system. In this respect, where required with particularly sensative coating materials, highly susceptible to sedimentation, slow speed, air actuated agitating or stirring devices may be incorporated into the transfer tanks of the system of the invention, as will be readily understood.

The system of the invention also is readily incorporated into systems utilizing color change facilities. For this purpose, the sets of transfer vessels may be utilized in cooperating pair of systems, such that one system may be brought into operation with a coating material of a new color, while the just-used system is drained, cleaned and made ready for a subsequent new color. Alternatively, a separate set of transfer vessels may be provided for each color.

An advantageous feature of the invention involves the utilization, in conjunction with a two vessel transfer system, of an electrically interlocked, time-delay system for shutting off the fluid control valve of one vessel before opening the corresponding valve of the other vessel. This effectively prevents formation of a momentary continuous electrical path through the system that could cause the high voltage charge to be conducted back to the primary source of coating material.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A pressurizable supply vessel to receive and retain a supply of electrically conductive liquid material and for use in a high voltage electrostatic paint spray system including a supply system provided with means to prevent electrical current passage therethrough, said vessel characterized by a. a cylindrical body supported in vertical axial orientation, b. a pair of end caps comprised of electrically insulating material disposed in fluid sealing engagement with said body at the top and bottom ends thereof, c. inlet means in said top end cap for receiving said electrical conductive material, d. said inlet means including a tube comprised of electrical insulating material, said tube extending lengthwise of said body, downwardly into said vessel, e. said tube terminating in a discharge opening spaced at predetermined minimum distances from the walls of said cylindrical body, and said top and bottom end caps, whereby said discharge opening is spaced beyond the arcing distance for voltages utilized in said electrostatic paint spray system, and f. outlet means in said bottom cap.

2. The apparatus of claim 1, further characterized by a. said discharge opening comprising horizontal semi-annular slots and b. said slots being configured and positioned to discharge said electrical conductive material in sheet-like streams outward against the walls of said body.

3. The apparatus of claim 1, further characterized by a. the inner surface of said top end cap being comprised of a material preventing adherence thereto by said electrical conductive material.

4. The apparatus of claim 3, further characterized by a. said inner surface of said top end cap being polytetrafluoroethylene.

5. The apparatus of claim 1, further characterized by a. said inlet means including a valve disposed adjacent said upper end cap; and b. electrically insulated spacer means disposed between said valve means and said top end cap.

6. The apparatus of claim 1, further characterized by a. an annular barrier element disposed below said discharge opening;

b. said barrier element having a control opening for the downward passage of said electrically conductive material; and c. said barrier element comprised of a material preventing adherence thereto by said electrical conductive material.

* * * * *